US009753420B1

(12) United States Patent
Uehara et al.

(10) Patent No.: US 9,753,420 B1
(45) Date of Patent: Sep. 5, 2017

(54) FIXING DEVICE AND IMAGE FORMING APPARATUS

(71) Applicant: FUJI XEROX CO., LTD., Tokyo (JP)

(72) Inventors: Yasuhiro Uehara, Kanagawa (JP); Kazuyoshi Itoh, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/214,524

(22) Filed: Jul. 20, 2016

(30) Foreign Application Priority Data

Feb. 18, 2016 (JP) ..... 2016-028815

(51) Int. Cl.
*G03G 15/20* (2006.01)

(52) U.S. Cl.
CPC ..... *G03G 15/2085* (2013.01); *G03G 15/2053* (2013.01)

(58) Field of Classification Search
CPC ..... G03G 15/2085; G03G 15/2053
See application file for complete search history.

(56) References Cited

U.S. PATENT DOCUMENTS

2003/0029853 A1* 2/2003 Izawa ..... G03G 15/2053 219/216
2005/0140491 A1* 6/2005 Uehara ..... H01H 37/761 337/401
2010/0215391 A1* 8/2010 Namiki ..... G03G 15/2039 399/70

FOREIGN PATENT DOCUMENTS

JP 2008-28089 A 2/2008
JP 2010-086675 A 4/2010
JP 2011-204516 A 10/2011
JP 2013-503441 A 1/2013
WO 2011/025535 A1 3/2011

* cited by examiner

*Primary Examiner* — Rodney Bonnette
(74) *Attorney, Agent, or Firm* — Sughrue Mion, PLLC

(57) ABSTRACT

A fixing device includes an endless belt, a planar heater, a thermal fuse element, and an elastic member. The belt fixes a toner image to a recording medium. The heater heats the endless belt. The thermal fuse element has ends, has a length equal to or larger than an image forming width of the toner image formed on the recording medium, and is in contact with the heater. The elastic member supports at least one of the ends of the thermal fuse element.

5 Claims, 7 Drawing Sheets

FIXING DEVICE AND IMAGE FORMING APPARATUS

CROSS-REFERENCE TO RELATED APPLICATIONS

This application is based on and claims priority under 35 USC 119 from Japanese Patent Application No. 2016-028815 filed Feb. 18, 2016.

BACKGROUND

Technical Field

The present invention relates to a fixing device and an image forming apparatus.

SUMMARY

According to an aspect of the present invention, a fixing device includes an endless belt, a planar heater, a thermal fuse element, and an elastic member. The belt fixes a toner image to a recording medium. The heater heats the endless belt. The thermal fuse element has ends, has a length equal to or larger than an image forming width of the toner image formed on the recording medium, and is in contact with the heater. The elastic member supports at least one of the ends of the thermal fuse element.

BRIEF DESCRIPTION OF THE DRAWINGS

Exemplary embodiment of the present invention will be described in detail based on the following figures, wherein.

DETAILED DESCRIPTION

An exemplary embodiment of the present invention will be described in detail below with reference to the drawings.

Hereafter, yellow, magenta, cyan, and black are respectively denoted by signs Y, M, C, and K. Also, when elements and toners images (images) need to be identified in terms of colors, the signs of the colors (Y, M, C, and K) corresponding to the colors are added to the ends of signs of the elements and the toner images. Furthermore, hereafter, the signs of the colors at the ends of the signs of the elements and the toner images are omitted when the elements or the toner images are generally referred to without the identification in terms of the colors.

General Structure

Figure 1:
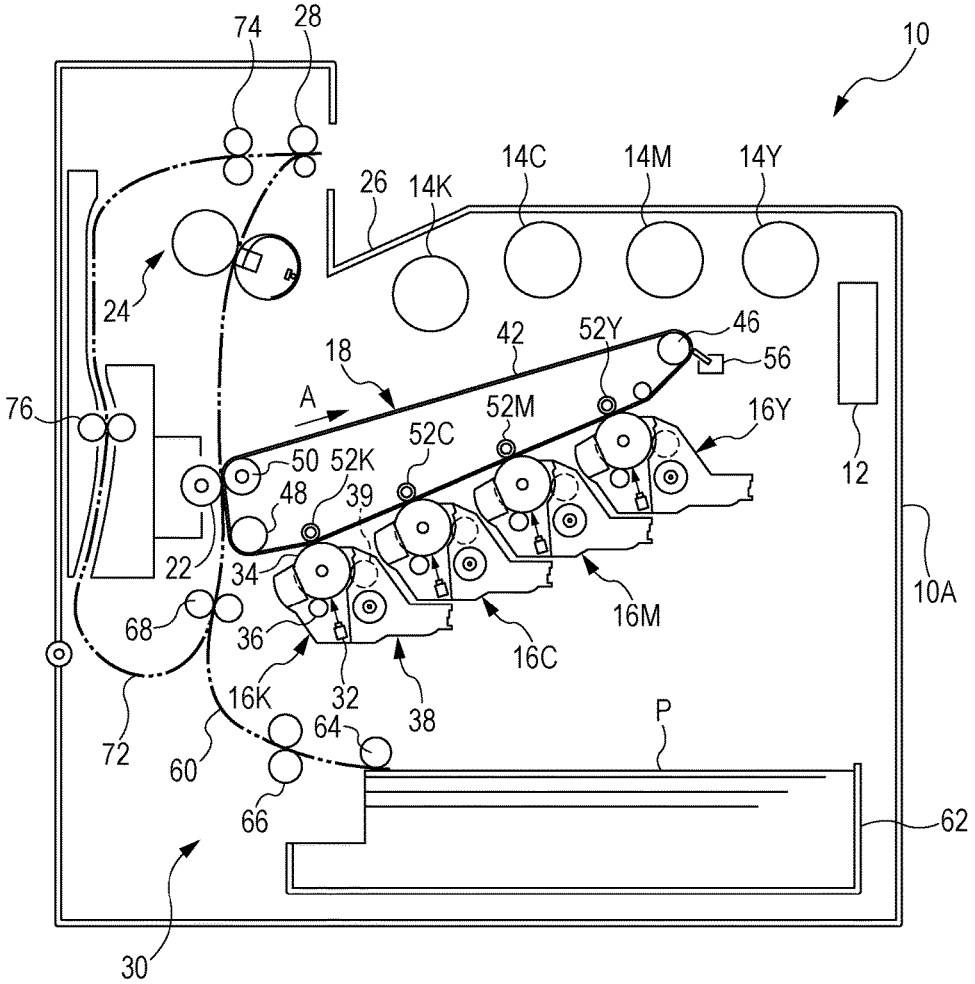
FIG. 1 illustrates an example of a structure of an image forming apparatus.

As illustrated in FIG. 1, an image processing unit 12 is provided in an apparatus body 10A of an image forming apparatus 10. The image processing unit 12 performs image processing in which image data input thereto is converted into gradation data of the four colors, that is, Y, M, C, and K.

Furthermore, image forming units 16 that form toner images of the colors are spaced apart from one another in a direction inclined relative to the horizontal direction in a central portion of the apparatus body 10A. A first transfer unit 18 is provided above the image forming units 16 of the colors in the vertical direction. The toner images formed in the image forming units 16 of the colors are transferred onto the first transfer unit 18 so as to be superposed on one another.

Furthermore, a second transfer roller 22 is provided to the side (left side in FIG. 1) of the first transfer unit 18. The toner images having been transferred onto the first transfer unit 18 so as to be superposed on one another are transferred by the second transfer roller 22 onto a sheet of paper P having been transported along a transport path 60 by a feed/transport unit 30 which will be described later. The sheet P is an example of a recording medium.

A fixing device 24 is provided downstream of the second transfer roller 22 in a transport direction of the sheet P (referred to as "sheet transport direction" hereafter). The fixing device 24 uses heat and pressure so as to fix onto the sheet P the toner images having been transferred onto the sheet P.

Furthermore, an output roller 28 is provided downstream of the fixing device 24 in the sheet transport direction. The output roller 28 outputs the sheet P onto which the toner images have been fixed to an output unit 26 provided in an upper portion of the apparatus body 10A of the image forming apparatus 10.

The feed/transport unit 30 that feeds and transports the sheet P is provided in a region ranging from a region below the image forming units 16 in the vertical direction to a region to the side of the image forming units 16. Furthermore, toner cartridges 14 of four colors (14K to 14Y) are arranged side by side in an apparatus width direction above the first transfer unit 18 in the vertical direction. The toner cartridges 14 are detachably attached to the apparatus body 10A through the front of the apparatus body 10A and filled with the toner with which developing devices 38 are replenished. The toner cartridges 14 of the colors each have a cylindrical shape extending in an apparatus depth direction and are each connected to a corresponding one of the developing devices 38 through a replenishing pipe (not illustrated).

The Image Forming Units

As illustrated in FIG. 1, the image forming units 16 of the colors have the same or similar structures. The image forming units 16 each include a cylindrical image holding body 34 that is rotated and a charger 36 that charges a surface of the image holding body 34.

The image forming unit 16 also includes a light emitting diode (LED) head 32 that radiates exposure light to the surface of a corresponding one of the image holding bodies 34 having been charged. The image forming unit 16 also includes the developing device 38 that develops with developer (toner charged to the negative polarity according to the present exemplary embodiment) an electrostatic latent image formed by radiation of the exposure light from the LED head 32, thereby making the electrostatic latent image visible as a toner image. The image forming unit 16 also includes a cleaning blade (not illustrated) that cleans the surface of the image holding body 34.

A developing roller 39 is disposed so as to face the image holding body 34 in the developing device 38. The developing device 38 uses the developing roller 39 so as to develop with the developer the electrostatic latent image formed on the image holding body 34, thereby making the electrostatic latent image visible as the toner image.

The charger 36, the LED head 32, the developing roller 39, and the cleaning blade face the surface of the image holding body 34 and are arranged in this order from the upstream side to the downstream side in a rotational direction of the image holding body 34.

A Transfer Unit (the First Transfer Unit and the Second Transfer Roller)

The first transfer unit 18 includes an endless intermediate transfer belt 42 and a drive roller 46. The intermediate transfer belt 42 is looped over the drive roller 46. The drive roller 46 is driven by a motor (not illustrated), thereby rotating the intermediate transfer belt 42 in an arrow A direction. The first transfer unit 18 also includes a tension applying roller 48 and an auxiliary roller 50. The intermediate transfer belt 42 is looped over the tension applying roller 48 that applies tension to the intermediate transfer belt 42. The auxiliary roller 50 is disposed above the tension applying roller 48 in the vertical direction and is rotated together with the intermediate transfer belt 42. The first transfer unit 18 also includes first transfer rollers 52 disposed on the opposite side to the image holding bodies 34 of the respective colors with the intermediate transfer belt 42 interposed therebetween.

With the above-described structure, toner images of the Y, M, C, and K colors sequentially formed on the image holding bodies 34 of the image forming units 16 for the respective colors are transferred onto the intermediate transfer belt 42 by the first transfer rollers 52 for the respective colors so as to be superposed on one another.

Furthermore, a cleaning blade 56 is disposed on the opposite side to the drive roller 46 with the intermediate transfer belt 42 interposed therebetween. The cleaning blade 56 is in contact with a surface of the intermediate transfer belt 42 so as to clean the surface of the intermediate transfer belt 42.

Furthermore, the second transfer roller 22 is provided on the side opposite to the auxiliary roller 50 with the intermediate transfer belt 42 interposed therebetween. The second transfer roller 22 transfers the toner images having been transferred onto the intermediate transfer belt 42 onto the sheet P being transported. The second transfer roller 22 is grounded, and the auxiliary roller 50 serves as a counter electrode of the second transfer roller 22. A second transfer voltage is applied to the auxiliary roller 50, thereby the toner images are transferred onto the sheet P.

The Feed/Transport Unit

The feed/transport unit 30 is disposed below the image forming units 16 in the vertical direction in the apparatus body 10A and includes a sheet feed device 62 in which plural sheets of paper P are stacked.

The feed/transport unit 30 also includes a sheet feed roller 64, a separation roller 66, and a registration roller 68. The sheet feed roller 64 feeds the sheets P stacked in the sheet feed device 62 to the transport path 60. The separation roller 66 separates one sheet after another from the sheets P fed by the sheet feed roller 64. The registration roller 68 adjusts timing of transportation of the sheets P. These rollers are arranged in this order from the upstream side to the downstream side in the sheet transport direction.

With the above-described structure, the sheets P having been fed from the sheet feed device 62 is fed at a predetermined timing to a contact portion (second transfer position) between the intermediate transfer belt 42 and the second transfer roller 22 by the rotating registration roller 68.

An Image Forming Process

Initially, the gradation data of the colors is sequentially output from the image processing unit 12 to the LED heads 32 for the colors. The exposure light emitted by the LED heads 32 in accordance with the gradation data is radiated to the surfaces of the image holding bodies 34 charged by the chargers 36. Thus, electrostatic images are formed on the surfaces of the image holding bodies 34. The electrostatic latent images formed on the image holding bodies 34 are developed by the developing devices 38 for the respective colors so as to be made visible as the toner images of the colors, Y, M, C, and K.

Furthermore, the toner images of the colors formed on the image holding bodies 34 are transferred so as to be superposed on one another by the first transfer rollers 52 of the first transfer unit 18 onto the rotating intermediate transfer belt 42.

The toner images of the colors having been transferred onto the intermediate transfer belt 42 and superposed on one another are transferred by the second transfer roller 22 at the second transfer position through second transfer onto the sheet P having been transported from the sheet feed device 62 along the transport path 60 by the sheet feed roller 64, the separation roller 66, and the registration roller 68.

Furthermore, the sheet P onto which the toner images have been transferred is transported to the fixing device 24. The toner images are fixed onto the sheet P by the fixing device 24. The sheet P onto which the toner images have been fixed is output to the output unit 26 by the output roller 28.

Meanwhile, in the case where images are formed on both sides of the sheet P, processing is different from processing in which the sheet P onto one side (front side) of which the toner images have been fixed by the fixing device 24 is output to the output unit 26 by the output roller 28 as it is. In this case, the output roller 28 is rotated in the opposite direction so as to switch the sheet transport direction of the sheet P. This sheet P is transported along a duplex transport path 72 by transport rollers 74 and 76.

The sheet P is inverted while being transported along the duplex transport path 72. The inverted sheet P is transported again to the registration roller 68. Toner images are transferred and fixed onto another side (back side) of the sheet P. Then, the sheet P is output to the output unit 26 by the output roller 28.

The Fixing Device

Next, the fixing device 24 of the image forming apparatus 10 is described in detail.

Figure 2:
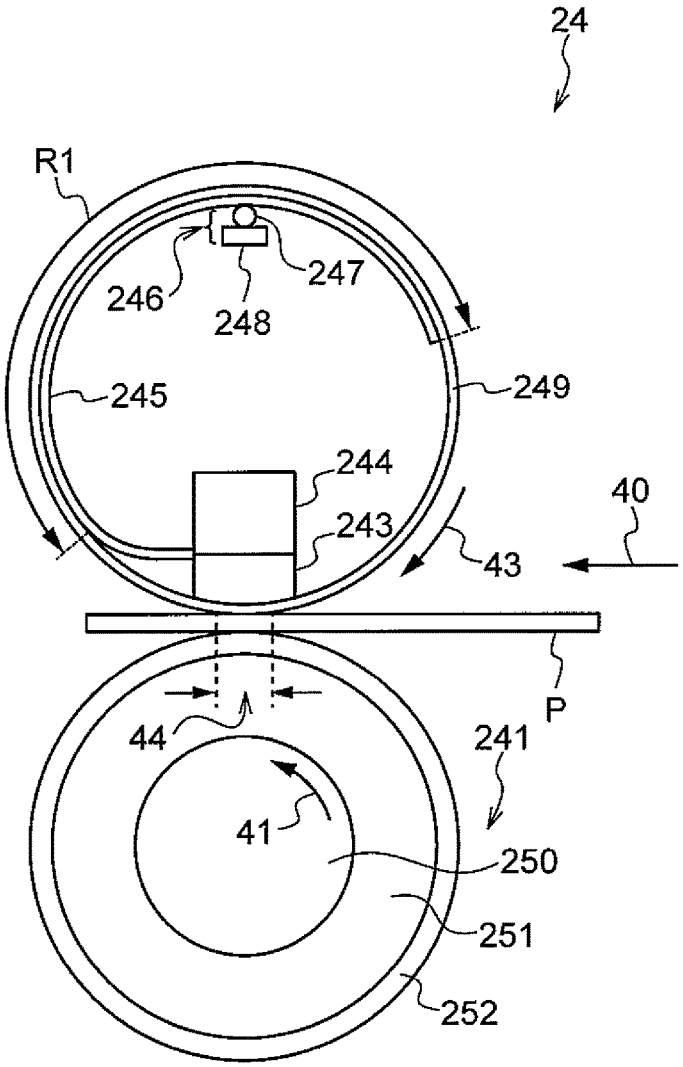
FIG. 2 illustrates an example of a structure of a fixing device when the fixing device is seen in a rotational axis direction.

As illustrated in FIG. 2, the fixing device 24 according to the present exemplary embodiment includes a pressure roller 241 and a fixing belt 249. The pressure roller 241 is rotated in an arrow 41 direction by a drive device such as a motor (not illustrated). The fixing belt 249 serves as an example of an endless belt and is in contact with the pressure roller 241 so as to follow the rotation of the pressure roller 241. Thus, the fixing belt 249 is rotated in an arrow 43 direction. The fixing belt 249 is, as will be described later, heated to a preset temperature by a heater 245 provided on the inner circumferential side of the fixing belt 249. The temperature of the fixing belt 249 is set in accordance with, for example, the transport speed of the sheet P.

In the fixing device 24, the pressure roller 241 and the fixing belt 249 nip the sheet P transported in an arrow 40 direction in a nip 44 formed therebetween. While heating by using the fixing belt 249 the toner images having been transferred onto the sheet P, the fixing device 24 presses the toner images against the sheet P by a pressing force of the pressure roller 241 and fixing belt 249 applied when the sheet P is nipped in the nip 44. This causes the toner images to be fixed onto the sheet P.

The fixing belt 249 is an endless belt having a cylindrical shape. A fixing pad 243, an inner structure 244, the heater 245, and a thermal fuse 246 are disposed on the inner circumferential side of the fixing belt 249. The fixing belt 249 is disposed such that the height direction of the cylindrical shape is perpendicular to the transport direction of the sheet P represented by the arrow 40 direction, that is, the height direction of the cylindrical shape extends in the width direction of the sheet P. The direction of the fixing belt 249 extending in the width direction of the sheet P is referred to as "width direction of the fixing belt 249" hereafter.

In order to allow the heater 245 to be in contact with the fixing belt 249 over a predetermined length, the planar heater 245 is attached to the fixing belt 249 such that one end portion of the heater 245 is secured by being pinched between the fixing pad 243 and the inner structure 244 and another end portion of the heater 245 is not secured and set as a free end in contact with the fixing belt 249.

The heater 245 generates heat in accordance with, for example, the magnitude of a current supplied to the heater 245 and heats the fixing belt 249 in contact with the heater 245. The planar heater 245 is rolled to have a substantially cylindrical shape so as to be in contact with the fixing belt 249. At this time, the diameter of the rolled heater 245 is larger than the diameter of the fixing belt 249. When the heater 245 having been formed as described above is attached to the fixing belt 249 on the inner circumferential side of the fixing belt 249, a restoring force to restore the heater 245 to the original shape of the heater 245 acts on the fixing belt 249. Thus, the heater 245 acts on itself so as to be in close contact with the fixing belt 249.

It is noted that a heater such as a heater 245 that is deformable to follow the shape of, for example, an object to be heated (fixing belt 249 according to the present exemplary embodiment) may be referred to a "flexible heater".

The fixing pad 243 is an example of a pressure member formed of a material including, for example, a liquid crystal polymer. The fixing pad 243 is disposed at a position facing the pressure roller 241 and forms the nip 44 together with the pressure roller 241. A surface of the fixing pad 243 facing the nip 44 in contact with the rotating fixing belt 249 presses, together with the pressure roller 241, the sheet P so as to cause the toner images having been transferred onto the sheet P to be fixed onto the sheet P.

The inner structure 244 is disposed on an upper portion of the fixing pad 243 so as to pinch, together with the fixing pad 243, the one end portion of the heater 245. The inner structure 244 includes, for example, a circuit (referred to as "current circuit" hereafter) to supply the current to the heater 245.

Furthermore, the linear thermal fuse 246 is disposed on an opposite surface of the heater 245 to the surface in contact with the fixing belt 249 (referred to as "inner surface of the heater 245" hereafter) so as to be in contact with the heater 245 in the width direction of the fixing belt 249. Specifically, the thermal fuse 246 includes a fuse element 247 and a support 248 to which the fuse element 247 is attached. The thermal fuse 246 is disposed on the fixing belt 249 such that the fuse element 247 is in contact with the inner surface of the heater 245.

Meanwhile, the pressure roller 241 is a drive roller and includes a rotating shaft 250, a silicone rubber layer 251, and a tetrafluoroetylene-perfluoroalkylvinylether copolymer (PFA) tube 252. The rotating shaft 250 having a cylindrical shape is formed of metal and rotated in the arrow 41 direction by a drive force of the motor (not illustrated). The silicone rubber layer 251 has a thickness of about 5 mm and is wound around the rotating shaft 250. An outer surface of the silicone rubber layer 251 is covered with the PFA tube 252. Since an elastic member such as silicone rubber is wound around the rotating shaft 250, when the sheet P is pressed in the nip 44, the pressure roller 241 presses the sheet P while being deformed by a reaction against the a pressing force applied to the sheet P.

In the fixing device 24 according to the present exemplary embodiment, for example, the lengths of the pressure roller 241, the fixing belt 249, and the heater 245 are about 320 mm in the width direction of the sheet P, and the diameter of the pressure roller 241 is about 28 mm.

Furthermore, the length of the heater 245 from the one end thereof secured by the fixing pad 243 and the inner structure 244 to the free end is about 75 mm, and out of this length, a range of about 45 mm (range represented as R1 of FIG. 2) is in contact with the fixing belt 249 in a circumferential direction of the fixing belt 249. In the range where the fixing belt 249 and the heater 245 are in contact with each other, the fixing belt 249 is pressed against the heater 245 by a force of about 2 kg applied due to the restoring force of the heater 245, thereby the fixing belt 249 and the heater 245 are in close contact with each other.

A rated power is about 900 W when an alternating voltage of 100 V is applied to the heater 245 according to the present exemplary embodiment. Thus, the temperature of the heater 245 is adjusted so that, for example, the temperature of the fixing belt 249 is about 160° C. when the transport speed of the sheet P is about 252 mm/s. Specifically, since the fixing belt 249 is indirectly heated by the heater 245, the temperature of the heater 245 is adjusted to a higher temperature than a target temperature of about 160° C. of the fixing belt 249. Specifically, the temperature of the heater 245 is adjusted to about 190° C.

Furthermore, the length of the nip 44 of the fixing device 24 according to the present exemplary embodiment is about 8 mm in the transport direction of the sheet P, and the pressing force applied to the sheet P in the nip 44 is adjusted to about 30 kg.

Of course, the above-described specific values relating to the fixing device 24 are examples and not limiting.

Figure 3:
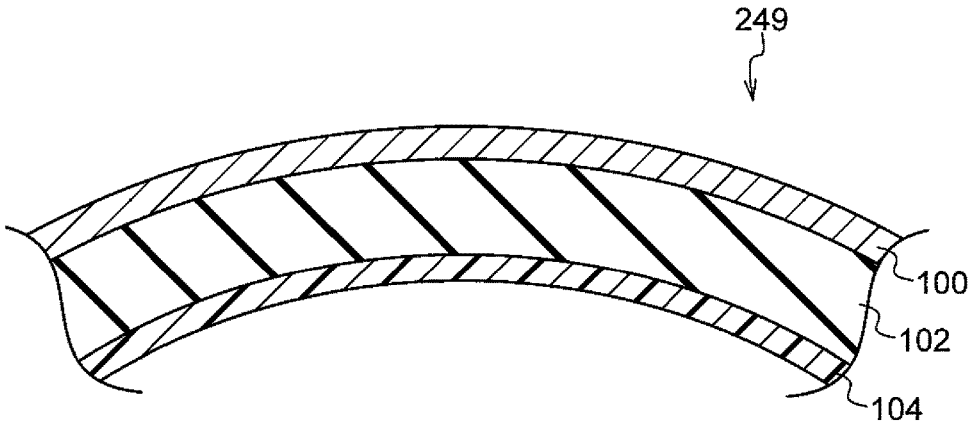
FIG. 3 illustrates an example of a sectional structure of a fixing belt.

Next, the fixing belt 249 is described in detail. FIG. 3 illustrates an example of a sectional structure of the fixing belt 249. As illustrated in FIG. 3, the fixing belt 249 includes three layers, that is, a mold release surface layer 100, an elastic layer 102, and a base layer 104 disposed in this order from a surface thereof brought into contact with the sheet P toward a surface thereof in contact with the heater 245.

The mold release surface layer 100 is formed of, for example, a PFA, polytetrafluoroethylene (PTFE), a silicone copolymer, or a composite material containing these and has a thickness of from about 10 to about 50 μm.

The elastic layer 102 is formed of an elastic material such as, for example, silicone rubber having a hardness of from about 10 to about 60° and has a thickness of from about 100 to about 400 μm.

The base layer 104 is formed of, for example, a resin material such as polyimide having a thickness of from about 50 to about 100 μm.

Although an endless belt having a diameter of about 30 mm is used as the fixing belt 249 according to the present exemplary embodiment, the diameter of the fixing belt 249 is not limited to this.

Figure 4:
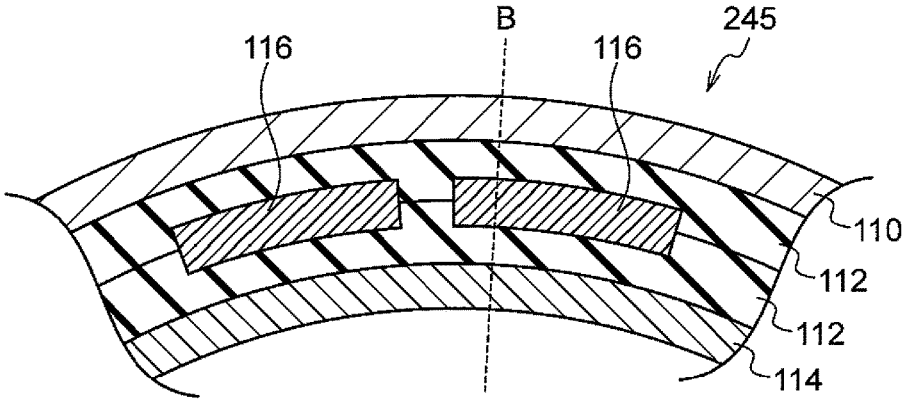
FIG. 4 illustrates an example of a sectional structure of a heater.

Next, the heater 245 is described in detail. FIG. 4 illustrates an example of a sectional structure of the heater 245.

As illustrated in FIG. 4, the heater 245 is a flexible heater having a thickness of about 140 μm. The heater 245 has a five-layer structure including five layers, that is, a thermally conductive layer 110, an insulation layer 112, a heat generating layer 116, the insulation layer 112, and a support layer 114 in this order from the surface thereof in contact with the fixing belt 249 toward the inner surface thereof at the position of broken line B.

The thermally conductive layer 110 is formed of, for example, stainless steel having a thickness of about 30 μm. The thermally conductive layer 110 is in contact with the fixing belt 249, thereby conducting heat of the heat generating layer 116 to the fixing belt 249 so as to heat the fixing belt 249.

The insulation layers 112 are each formed of, for example, a resin material such as polyimide having a thickness of about 25 μm. The heat generating layer 116 is interposed between two insulation layers 112, thereby the heat generating layer 116 is electrically insulated.

As is the case with the thermally conductive layer 110, the heat generating layer 116 is formed of, for example, stainless steel having a thickness of about 30 μm. The heat generating layer 116 is connected to, for example, the current circuit provided in the inner structure 244. When the current is supplied from the current circuit, the stainless steel generates heat in accordance with the magnitude of the current supplied to the stainless steel.

As is the case with the thermally conductive layer 110 and the heat generating layer 116, the support layer 114 is also formed of, for example, stainless steel having a thickness of about 30 μm. The support layer 114 covers the insulation layer 112, increases the structural strength of the heater 245, and supports the thermally conductive layer 110, the insulation layers 112, and the heat generating layer 116. The thermal fuse 246 is disposed so that the fuse element 247 is in contact with the support layer 114.

Figure 5:
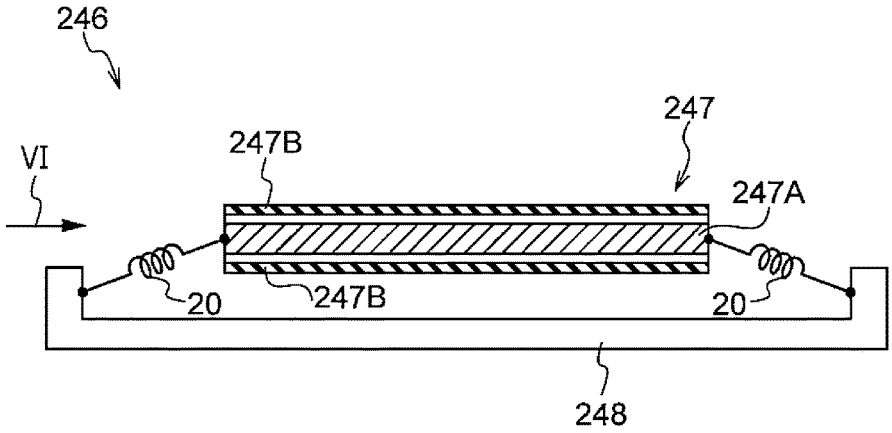
FIG. 5 is a schematic view of an example of a structure of a thermal fuse seen in a transport direction of a sheet of paper.

Next, the thermal fuse 246 is described in detail. FIG. 5 is a schematic view of a structure of the thermal fuse 246 seen in the transport direction of the sheet P.

As illustrated in FIG. 5, the thermal fuse 246 includes the fuse element 247 and the support 248. The fuse element 247 is in contact with the support layer 114 of the heater 245 and blows when the temperature of the heater 245 increases to an allowable temperature or higher. The support 248 supports the fuse element 247.

Electrically conductive elastic members 20 such as metal springs are attached at respective ends of the fuse element 247 in the width direction of the fixing belt 249. One end of each of the elastic members 20 is attached at one of the ends of the fuse element 247 in the width direction of the fuse element 247, and another end of each of the elastic members 20 is attached to the support 248. Thus, the fuse element 247 is attached to the support 248 in a form in which the fuse element 247 is pulled from both the ends by the elastic members 20. To attach the fuse element 247 to the support 248 while pulling the fuse element 247 by using the elastic members 20 is referred to as "to stretch the fuse element 247". According to the present exemplary embodiment, the fuse element 247 is stretched by the elastic members 20 with a tension of about 0.5 N.

The other ends of the elastic members 20 attached to the support 248 are connected to connecting lines (not illustrated), which are connected to, for example, a coil of a relay (not illustrated) and a direct-current (DC) power source (not illustrated) disposed in the inner structure 244. That is, the fuse element 247, the elastic members 20, the connecting lines (not illustrated), the coil of the relay (not illustrated), and the DC power source (not illustrated) are connected in series so as to form a closed circuit.

Thus, when the temperature of the heater 245 reaches the allowable temperature or a temperature around the allowable temperature, and accordingly, the fuse element 247 blows, the current flowing through the closed circuit including the fuse element 247 is interrupted. This turns off a contact driven by the coil of the relay (not illustrated). Thus, a state in which the temperature of the heater 245 reaches the allowable temperature or a temperature around the allowable temperature in the fixing device 24 is detectable.

Referring to FIG. 5, the fuse element 247 is stretched by attaching the elastic members 20 to both the ends of the fuse element 247. However, the fuse element 247 is not necessarily stretched in this form. For example, the fuse element 247 may be stretched as follows: one of the ends of the fuse element 247 is attached to the support 248 by one of the elastic members 20, and the other end of the fuse element 247 is attached to the support 248 by an electrically conductive wire or the like instead of another elastic member 20.

Furthermore, in the case where it is difficult to directly attach the elastic members 20 to the fuse element 247, the fuse element 247 may be connected to the elastic members 20 through, for example, electrically conductive wires having composition with which the electrically conductive wires are easily attached to the fuse element 247.

Even in the above-described forms, the fuse element 247 is stretched by one or both of the elastic members 20 in the support 248. Furthermore, the positions where the relay (not illustrated) and the DC power source (not illustrated) are disposed are not limited to a space inside the inner structure 244.

Figure 6:
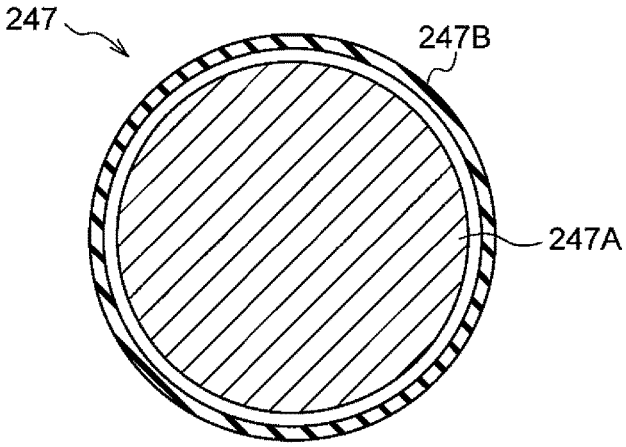
FIG. 6 is a schematic view of an example of a section of a fuse element seen in a width direction of the fixing belt.

FIG. 6 is a schematic view of an example of a section of the fuse element 247 when the fuse element 247 is seen in an arrow VI direction of FIG. 5, that is, in the width direction of the fixing belt 249.

Referring to FIGS. 5 and 6, the fuse element 247 includes a fusible member 247A having a cylindrical shape and a heat-resistant insulation tube 247B that has a hollow shape and covers the fusible member 247A. The diameter of the fusible member 247A is about 0.4 mm and a length of the fusible member 247A in the width direction of the fixing belt 249 is about 320 mm. The heat-resistant insulation tube 247B is formed of, for example, a resin material such as polyimide. The inner diameter and the outer diameter of the heat-resistant insulation tube 247B are respectively about 0.5 mm and about 0.54 mm.

Flux may be injected into a space formed by the heat-resistant insulation tube 247B and the fusible member 247A. The flux suppresses the degree of progress of oxidation caused by direct contact of the fusible member 247A with air and suppresses reoxidation of the fusible member 247A caused by heat of the heater 245.

The fusible member 247A is an alloy containing, for example, tin, silver, and copper. The melting point of the fusible member 247A, that is, the blowing temperature of the fusible member 247A is set by adjusting the content of each of the elements. Although the blowing temperature of the fusible member 247A according to the present exemplary embodiment is set to, for example, about 220° C., of course, the blowing temperature is not limited to this. The blowing temperature of the fusible member 247A is set in accordance with the allowable temperature of the heater 245.

Specifically, the blowing temperature of the fusible member 247A is set so as to be coincident with the allowable temperature of the heater 245.

The fusible member 247A, the length of which is about 320 mm in the width direction of the fixing belt 249, may liquefy, scatter therearound, and adhere to the fixing device 24 when the fusible member 247A blows. However, since the fusible member 247A is covered with the heat-resistant insulation tube 247B, a situation in which the liquefied fusible member 247A scatters therearound and adheres to the fixing device 24 when the fusible member 247A blows may be prevented.

Furthermore, in order to allow the fuse element 247 to detect the temperature of the heater 245 over the entire width of the heater 245, the length of the fuse element 247 in the width direction of the fixing belt 249 is, for example, about 320 mm which is equal to or substantially equal to the width of the heater 245. It is noted that this is only an example, and the length of the fuse element 247 may exceed the width of the heater 245.

Here, the term "width of the heater 245" refers to the length of the heater 245 in the width direction of the fixing belt 249. Accordingly, the width direction of the heater 245 is coincident with the width direction of the fixing belt 249. Furthermore, the length of the fuse element 247 in the width direction of the fixing belt 249 is referred to as "length of the fuse element 247", and the length of the fuse element 247 is referred to as "length of the thermal fuse 246".

Next, stretching operation for the fuse element 247 is described.

In the case of generally used thermal fuses including a fuse element 247 having a length from several mm to several cm, when the temperature of the fusible member 247A of the fuse element 247 increases to the blowing temperature or higher, the ends of a blowing part of the fusible member 247A is separated from each other while being formed into a spherical shape due to surface tension. Thus, the fuse element 247 blows.

However, when the length of the fuse element 247 increases to several tens of cm or larger as the thermal fuse 246 according to the present exemplary embodiment, the fusible member 247A of the fuse element 247 expands and starts to sag due to the effect of the heat of the heater 245. In this case, the distance between the heat-resistant insulation tube 247B and the fusible member 247A is reduced. Thus, even when the temperature of the fusible member 247A increases to the blowing temperature or higher and the fusible member 247A starts to blow, it may be difficult, compared to the case of a generally used thermal fuse 246, to form the ends of the blowing part of the fusible member 247A into the a spherical shape. That is, as the length of the fuse element 247 increases, it may become difficult to blow the fuse element 247 at a preset blowing temperature of the fuse element 247.

In order to address this, as illustrated in FIG. 5, in the thermal fuse 246 according to the present exemplary embodiment, both the ends of the fuse element 247, or more specifically, both ends of the fusible member 247A included in the fuse element 247 are pulled by the elastic members 20, thereby the fuse element 247 is stretched. In this case, even when the fusible member 247A of the fuse element 247 expands and sags due to the effect of the heat of the heater 245, tension that pulls the fusible member 247A in directions opposite to each other acts on both the ends of the fusible member 247A.

Thus, when the temperature of the fusible member 247A increases to the blowing temperature or higher and the fusible member 247A starts to blow, forces to move the ends of the blowing part in separating directions act on the ends of the blowing part due to the tension acting on both the ends of the fusible member 247A. Thus, compared to the case where the fuse element 247 is attached to the support 248 without stretching the fuse element 247, the fusible member 247A easily blows.

Figure 7:
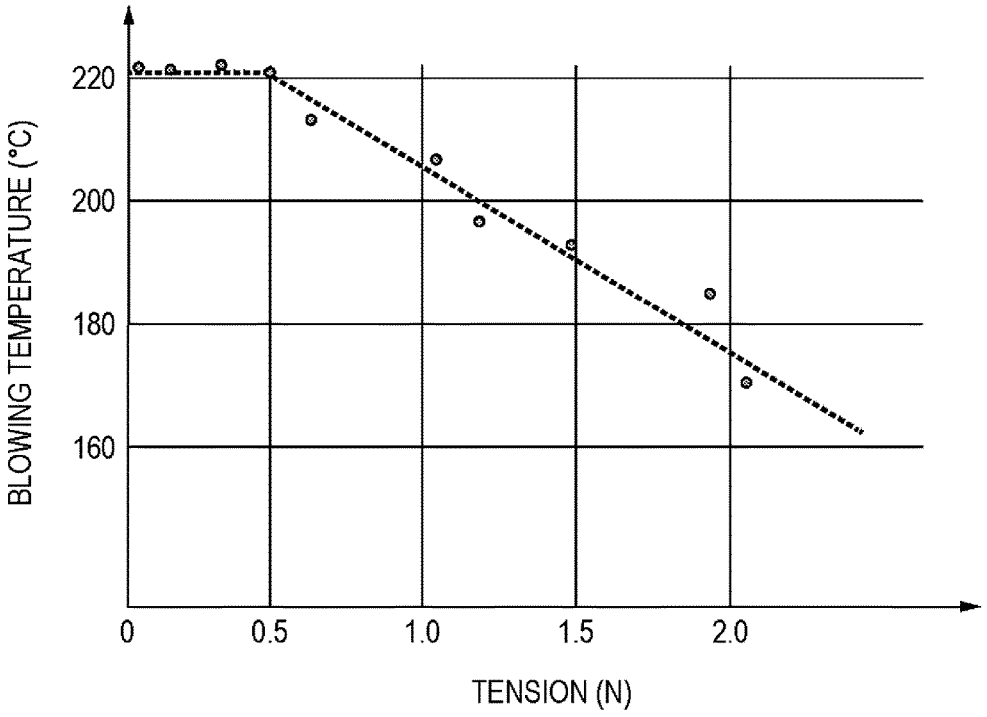
FIG. 7 is an example of a graph illustrating the relationship between tension for stretching the fuse element and a blowing temperature.

FIG. 7 is a graph of an example of variation in blowing temperature of the fuse element 247 with respect to the tension for stretching the fuse element 247. In the graph of FIG. 7, the horizontal axis represents the tension for stretching the fuse element 247 and the vertical axis represents the blowing temperature of the fuse element 247.

As illustrated in FIG. 7, regarding the blowing temperature of the fuse element 247, the following has been found: when the tension for stretching the fuse element 247 is a specific threshold or lower, the variation in blowing temperature of the fuse element 247 is within an allowable range where the blowing temperature is able to be regarded as not varying; and when the tension for stretching the fuse element 247 exceeds the threshold, the blowing temperature of the fuse element 247 tends to linearly reduce as the tension increases. In the case illustrated in the graph of FIG. 7, the threshold is about 0.5 N. In a range where the tension for stretching the fuse element 247 is from about 0 N to about 0.5 N, the blowing temperature of the fuse element 247 is about 220° C. In a range exceeding 0.5 N, the blowing temperature of the fuse element 247 is reducing.

Accordingly, the thermal fuse 246 according to the present exemplary embodiment is used with the fuse element 247 stretched in the support 248 by a tension in such a range that the variation in blowing temperature of the fuse element 247 is within the allowable range. In other words, the thermal fuse 246 according to the present exemplary embodiment detects the temperature of the heater 245 with the fuse element 247 stretched in the support 248 under a tension in such a range that the blowing temperature of the thermal fuse 246 substantially does not vary.

Verification of Operation of the Thermal Fuse

Figure 8:
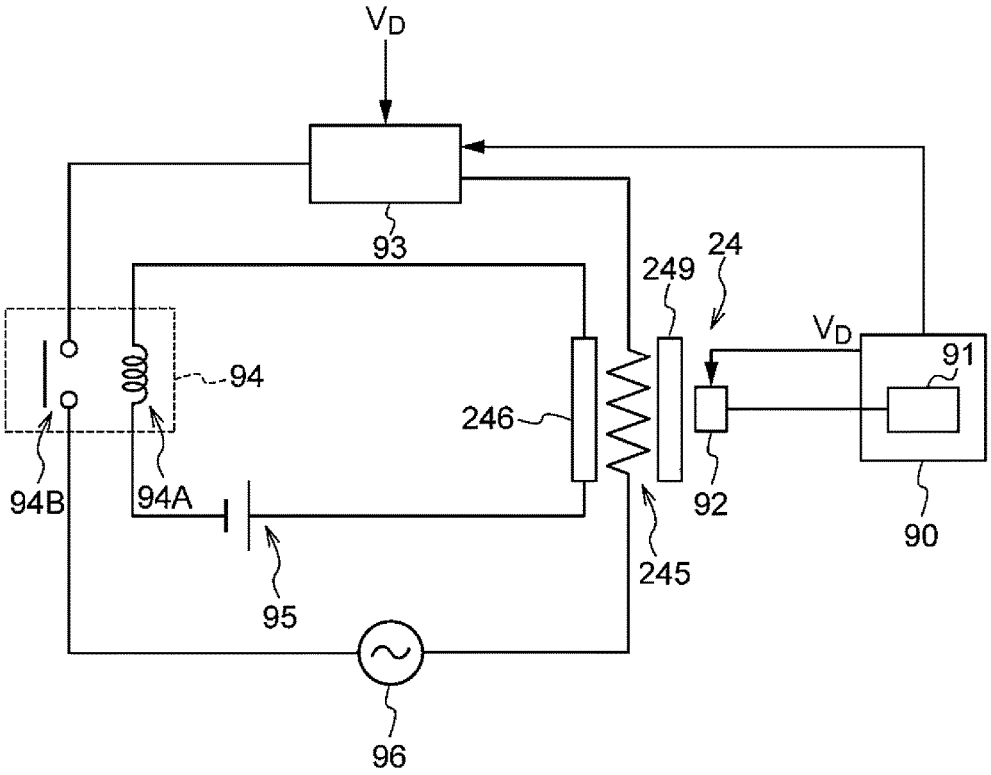
FIG. 8 illustrates an example of an evaluation circuit for the thermal fuse.

FIG. 8 illustrates an evaluation circuit. Operation of the thermal fuse 246 according to the present exemplary embodiment is verified with this evaluation circuit. As illustrated in FIG. 8, a DC power source 95 is connected in series to the thermal fuse 246 of the fixing device 24 through a coil 94A of a relay 94. Furthermore, a commercial alternating-current power source 96 is connected to the heater 245 of the fixing device 24 through a solid-state relay 93 and a contact 94B of the relay 94. A temperature sensor 92 is disposed near the fixing belt 249. A central processing unit (CPU) 91 of a control circuit 90 is notified of temperatures measured by the temperature sensor 92. The CPU 91 uses temperature information measured by the temperature sensor 92 so as to perform contactor control of the solid-state relay 93, thereby controlling the power supply time period for the heater 245. Thus, the temperature of the heater 245 is controlled.

In FIG. 8, $V_D$ represents a drive voltage of the temperature sensor 92 and the solid-state relay 93. Furthermore, the temperature sensor 92 measures the temperature of the fixing belt 249, the temperature of the heater 245, and the temperature of the thermal fuse 246.

Figure 9:
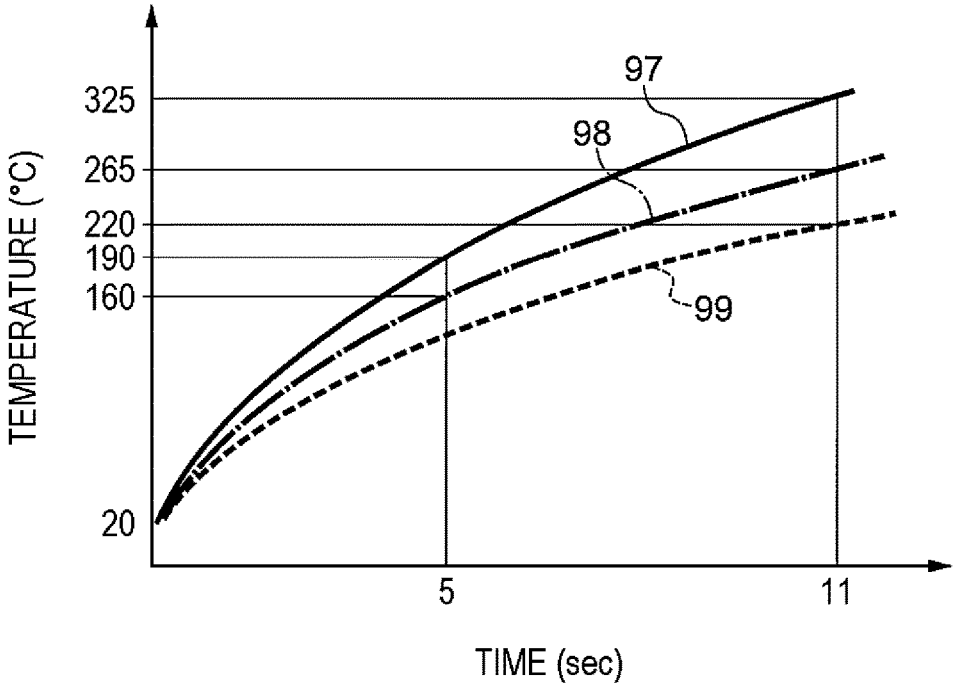
FIG. 9 includes graphs illustrating examples of temperature variations in parts of the fixing device in the evaluation circuit.

FIG. 9 includes graphs illustrating variations in temperature of the fixing belt 249, the heater 245, and the thermal fuse 246. In this case, it is assumed that the control circuit 90 has failed and the heater 245 is operated at the rated power without the control of the temperature of the heater 245 performed by the control circuit 90 (referred to as "evaluation of control system failure" hereafter). In FIG. 9, graph 97 represents the temperature of the heater 245, graph 98 represents the temperature of the fixing belt 249, and graph 99 represents the temperature of the thermal fuse 246. Also in FIG. 9, the horizontal axis represent a power supply time period of the heater 245, and the vertical axis represents the temperature.

In the evaluation of control system failure, a time period required to increase the temperature of the fixing belt 249 to the target temperature, that is, about 160° C., is 5 seconds. At this time, the temperature of the heater 245 is about 190° C. When the power supply to the heater 245 is continued and the temperature of the thermal fuse 246 has increased to about 220° C., the thermal fuse 246 blows. The blowing of the thermal fuse 246 occurs after 11 seconds from the start of the power supply to the heater 245. At the time when the thermal fuse 246 blows, the temperature of the fixing belt 249 is about 265° C. and the temperature of the heater 245 is about 325° C.

Furthermore, after about 1 minute from the blowing of the thermal fuse 246, the temperature of the fixing belt 249 is reduced to the target temperature, that is, about 160° C. due to natural cooling.

After the experiment of the evaluation of control system failure has been performed, whether or not there is a problem in the fixing device 24 due to the effect of the heat of the heater 245 is checked. As a result, no problem relating to the function of the fixing device 24 is found. Thus, it is confirmed that the fixing device 24 normally operates again by replacing the fuse element 247 of the thermal fuse 246.

Next, an evaluation of local heating is performed with the evaluation circuit of FIG. 8 as follows: a central portion of the heater 245 of 10 mm in width is floated from the fixing belt 249 by 0.5 mm, so that the heater 245 is not in contact with the fixing belt 249 in this portion; and the power is supplied to the heater 245.

In this evaluation of local heating, the thermal fuse 246 blows after about 4 seconds from the start of the power supply to the heater 245. At the time when the thermal fuse 246 blows, the temperature of the heater 245 in the portion where the heater 245 is not in contact with the fixing belt 249 is about 420° C.

Also after the experiment of the evaluation of local heating has been performed, whether or not there is a problem in the fixing device 24 due to the effect of the heat of the heater 245 is checked. As a result, no problem relating to the function of the fixing device 24 is found. Thus, it is confirmed that the fixing device 24 normally operates again by replacing the fuse element 247 of the thermal fuse 246.

Next, the evaluation of control system failure and the evaluation of local heating described above are performed with the evaluation circuit of FIG. 8, using a thermostat instead of the thermal fuse 246. A temperature at which a contact of the thermostat is turned off is set to about 220° C. that is the same as the blowing temperature of the thermal fuse 246. The thermostat is disposed at a position shifted from the portion where the heater 245 is floated from the fixing belt 249 by about 20 mm in the width direction of the heater 245.

In the evaluation of control system failure using the thermostat, the thermostat operates so as to stop the power supply to the heater 245 after about 15 seconds from the start of the power supply to the heater 245. At the time when the power supply to the heater 245 is stopped by the thermostat, the temperature of the fixing belt 249 is about 320° C. and the temperature of the heater 245 is 390° C. In this case, it is understood that the time period required to stop the power supply to the heater 245 is increased compared to that in the evaluation of control system failure using the thermal fuse 246.

After the experiment of the evaluation of control system failure using the thermostat has been performed, whether or not there is a problem in the fixing device 24 due to the effect of the heat of the heater 245 is checked. As a result, no problem relating to the function of the fixing device 24 is found. Thus, it is confirmed that the fixing device 24 normally operates again by replacing the operated thermostat.

In contrast, in the evaluation of local heating using the thermostat, even when the temperature of the heater 245 reaches the limit temperature of the heater 245, that is, about 450° C., the thermostat does not operate so as to stop the power supply to the heater 245. The reason for this is thought to be that the thermostat, which detects the temperature only around a position where the thermostat is disposed and a region in which the thermostat detects the temperature is limited compared to that of the thermal fuse 246, is not able to detects a change in temperature at a position shifted by 20 mm in the width direction of the heater 245 from the position where the thermostat is disposed.

That is, when the thermostat is used as a temperature detector for the heater 245, plural thermostats are required to detect the temperature of the entirety of the heater 245 in the width direction of the heater 245. However, the thermal fuse 246, which is in contact with the heater 245 from one end portion to another end portion of the heater 245 in the width direction of the heater 245, is able to detect the temperature of the entirety of the heater 245 in the width direction of the heater 245.

As has been described, with the fixing device 24 according to the present exemplary embodiment, the temperature of the heater 245 in the width direction of the heater 245 is detected by using the thermal fuse 246 that includes the fuse element 247 stretched therein by the elastic members 20 and having a length equal to or larger than the width of the heater 245.

Accordingly, the temperature of the heater 245 is able to be detected in a larger region than that in the case where the temperature of the heater 245 is detected by using a temperature sensor such as, for example, a thermostat or a generally used thermal fuse including the fuse element 247 having a length of about several mm to about several cm. This may allow detection of a local increase in temperature of the heater 245 so as to stop the power supply to the heater 245.

Furthermore, the thermal fuse 246 according to the present exemplary embodiment includes the fuse element 247 stretched by the elastic members 20. Thus, sagging of the fusible member 247A caused by the effect of heat is suppressed. This may facilitate the thermal fuse 246 to blow at the preset blowing temperature of the thermal fuse 246.

Furthermore, the fuse element 247 of the thermal fuse 246 according to the present exemplary embodiment has a so-called open structure in which the fusible member 247A is inserted into the heat-resistant insulation tube 247B. Thus, compared to the case where a fusible member is coated with flux and tightly sealed in an insulation casing so as to maintain airtightness as, for example, a generally used thermal fuse that includes the fuse element 247 having a length of from about several mm to about several cm, thermal capacity of the thermal fuse may be reduced, and accordingly, a temperature following property of the thermal fuse 246 may be improved.

According to the present exemplary embodiment, the length of the fuse element 247 of the thermal fuse 246 is equal to or larger than the width of the heater 245. However, the length of the fuse element 247 is not limited to this.

The width of the fixing belt 249 is set to be larger than the width of the sheet P having a maximum size among the sheets P used for the image forming apparatus 10. The fixing device 24 has a function of applying pressure and heat to the sheet P so as to fix the toner images having been transferred onto the sheet P onto the sheet P. When focusing on this function of the fixing device 24, the function of the fixing device 24 to fix the toner images onto the sheet P is able to be performed as long as whether or not the temperature of a region of the heater 245 corresponding to the width of the sheet P having a maximum size among the sheets P used for the image forming apparatus 10 exceeds the allowable temperature is able to be detected with the thermal fuse 246. Accordingly, it is sufficient that the length of the fuse element 247, that is, the length of the thermal fuse 246 be equal to or larger than the width of the sheet P having the maximum size among the sheets P used for the image forming apparatus 10.

Furthermore, the size of an image forming region in which the toner images are formed in the sheet P is predetermined in accordance with the size of the sheet P to be used. The size of the image forming region is set to be the size of the sheet P or smaller with consideration of, for example, borders. Accordingly, it is sufficient that the length of the fuse element 247, that is, the length of the thermal fuse 246 be equal to or larger than the width of a maximum image forming region corresponding to the sheet P having the maximum size among the sheets P used for the image forming apparatus 10.

Although the exemplary embodiment has been described to explain the present invention, the present invention is not limited to the scope of the description of the exemplary embodiment. A variety of changes or types of improvement may be added to the exemplary embodiment without departing from the gist of the present invention, and forms including the added changes or improvement are within the technical scope of the present invention.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

an endless belt that fixes a toner image to a recording medium;

a planar heater that heats the endless belt;

a thermal fuse element that has ends, that has a length equal to or larger than an image forming width of the toner image formed on the recording medium, and that is in contact with the heater; and an elastic member that supports at least one of the ends of the thermal fuse element.

2. The fixing device according to claim 1, wherein the elastic member supports the thermal fuse element with a tension which is in such a range that variation in blowing temperature of the thermal fuse element is within an allowable range.

3. The fixing device according to claim 2, wherein the thermal fuse element includes a fusible member that blows at a temperature equal to or higher than the blowing temperature, and a hollow covering member into which the fusible member is inserted.

4. The fixing device according to claim 1, wherein the thermal fuse element includes a fusible member that blows at a temperature equal to or higher than a blowing temperature, and a hollow covering member into which the fusible member is inserted.

5. An image forming apparatus comprising:

an image forming device that forms a toner image on a recording medium; and a fixing device according to claim 1 that fixes the toner image formed on the recording medium by the image forming device to the recording medium.

* * * * *